US011005189B2

(12) United States Patent
Herscovici

(10) Patent No.: US 11,005,189 B2
(45) Date of Patent: May 11, 2021

(54) TECHNIQUE FOR RECONSTRUCTION OF RADIATION PATTERNS FOR ANTENNAS WORKING IN CLOSE PROXIMITY OF CONDUCTIVE BODIES

(71) Applicant: US Govt as represented by Secretary of Air Force, Wright-Patterson AFB, OH (US)

(72) Inventor: Naftali Herscovici, Faiborn, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 8 days.

(21) Appl. No.: 16/744,251

(22) Filed: Jan. 16, 2020

(65) Prior Publication Data

US 2020/0259270 A1 Aug. 13, 2020

Related U.S. Application Data

(60) Provisional application No. 62/802,973, filed on Feb. 8, 2019.

(51) Int. Cl.
*H01Q 21/06* (2006.01)
*H01Q 15/14* (2006.01)
(Continued)

(52) U.S. Cl.
CPC ..... *H01Q 21/067* (2013.01); *H01Q 1/48* (2013.01); *H01Q 15/14* (2013.01); *H01Q 21/0037* (2013.01)

(58) Field of Classification Search
CPC ..... H01Q 21/067; H01Q 15/14; H01Q 1/48; H01Q 21/0037; H01Q 15/0026; H01Q 13/24
(Continued)

(56) References Cited

U.S. PATENT DOCUMENTS 6,323,809 B1 * 11/2001 Maloney ..... H01Q 1/38 343/700 MS
6,885,345 B2 4/2005 Jackson
(Continued)

OTHER PUBLICATIONS

Wang, S.Y., Tai, K. and Wang, M.Y. (2006), An enhanced genetic algorithm for structural topology optimization. Int. J. Numer. Meth. Engng., 65: 18-44. doi:10.1002/nme.1435.
(Continued)

*Primary Examiner* — Khai M Nguyen
(74) *Attorney, Agent, or Firm* — AFMCLO/JAZ; David E. Franklin

(57) ABSTRACT

An antenna assembly minimizes reflection from a proximate reflective surface over a wide band and over a wide range of incident angles as a multi-layer diffuser. The planar structure includes first and second planar layers, each layer having first areas that are more conductive than second areas. Each area has a periphery that extends along a grid of first and second sets of parallel lines so that each area comprises one or more contiguous elements defined by the lines. The first and second areas are configured and arranged so that the planar layer can communicate electromagnetic energy wirelessly in a specific direction to the planar layer when an electrical connection is made to the first area(s). The first planar layer is positioned on top of the second planar layer. The respective second areas of second planar layer aligned with a corresponding second area of the first planar layer.

10 Claims, 8 Drawing Sheets

(51) Int. Cl.
*H01Q 1/48* (2006.01)
*H01Q 21/00* (2006.01)

(58) Field of Classification Search
USPC ..... 343/834
See application file for complete search history.

(56) References Cited

U.S. PATENT DOCUMENTS 7,394,427 B2 * 7/2008 Cho ..... H01Q 21/0087
343/700 MS
10,658,758 B2 * 5/2020 Hafenrichter ..... H01Q 21/0087

OTHER PUBLICATIONS

Genetic algorithm optimization applied to electromagnetics: A review DS Weile, E Michielssen, IEEE Transactions on Antennas and Propagation 45 (3), 343-353.
Maloney, James G. et al. "Wide scan, integrated printed circuit board, fragmented aperture array antennas." 2011 IEEE International Symposium on Antennas and Propagation (APSURSI) (2011): 1965-1968.
Herscovici, Tuli & Champion, Michelle. (2014). "Antennas operating in close proximity of textured surfaces". 985-986. 10.1109/APS.2014.6904820.

* cited by examiner

TECHNIQUE FOR RECONSTRUCTION OF RADIATION PATTERNS FOR ANTENNAS WORKING IN CLOSE PROXIMITY OF CONDUCTIVE BODIES

CROSS-REFERENCE TO RELATED APPLICATIONS

This application claims the benefit of priority under 35 U.S.C. § 119(e) to U.S. Provisional Application Ser. No. 62/802,973 entitled "A Technique for Reconstruction of Radiation Patterns for Antennas Working in Close Proximity of Conductive Bodies," filed 8 Feb. 2019, the contents of which are incorporated herein by reference in their entirety.

ORIGIN OF THE INVENTION

The invention described herein was made by employees of the United States Government and may be manufactured and used by or for the Government of the United States of America for governmental purposes without the payment of any royalties thereon or therefore.

BACKGROUND

1. Technical Field

The present disclosure generally relates electromagnetic diffuser structures, and particularly relates to wide-angle planar electromagnetic diffuser structures.

2. Description of the Related Art

Applicant previously recognized the particular challenges antennas operating in close proximity of textured surfaces: Herscovici, Tuli & Champion, Michelle. (2014). "Antennas operating in close proximity of textured surfaces". 985-986. 10.1109/APS.2014.6904820. In this paper a method to reduce the interaction between antennas and nearby objects is proposed. It involves the use of a thin textured surface similar to a high-impedance layer that is wrapped around the objects that are in close proximity of the antenna (ground planes, various platforms, etc.). The textured surface acts as a "diffuser" spreading the reflected fields from the close objects and thereby reducing the power otherwise directed in the specular reflections. This method allows reducing the profile of endfire antennas working in close proximity to various platforms.

U.S. Pat. No. 6,88,534 B2 provides passive or active pixelized antenna structures in which the radio-frequency (RF) tuning of individual antenna pixel elements, the connections of individual antenna pixel elements to other antenna elements, and optionally the local phase of individual elements or groups of elements, is varied and controlled using tunable elements. Efficient and low-cost control of a large number of tunable elements is provided by matrix addressing techniques. The disclosure of U.S. Pat. No. 6,885,345 B2 is hereby incorporated by reference in its entirety.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

According to aspects of the present disclosure, an antenna assembly has a planar structure that minimizes the reflection from a proximate reflective surface over a wide band and over a wide range of incident angles as a multi-layer diffuser (MLD). The planar structure includes a first planar layer and a second planar layer. Each layer has a plurality of first areas and a plurality of second areas. The first areas are more conductive than the second areas. Each area has a periphery that extends along a grid of first and second sets of parallel lines so that each area comprises one or more contiguous elements defined by the lines. The first and second areas are configured and arranged so that the planar layer can communicate electromagnetic energy wirelessly in a specific direction to the planar layer when an electrical connection is made to at least one of the first areas. The first planar layer is positioned on top of the second planar layer. The respective second areas of second planar layer aligned with a corresponding second area of the first planar layer.

A new method to reduce the interaction between antennas and nearby objects is proposed. It involves the use of a thin textured surface similar to a high-impedance layer that is wrapped around the objects that are in close proximity of the antenna (ground planes, various platforms, etc.). The textured surface acts as a diffuser spreading the reflected fields from the close objects and thereby reducing the power otherwise directed in the specular reflections. This method allows reducing the profile of endfire antennas working in close proximity to various platforms. Specifically the novelty is in the use of topological optimization for the creation of a wide band, wide angle (WBWD) diffuser. WBWD diffusers are planar structures that minimize the reflection from a ground plane over a wide frequency band and over a wide range of incident angles. Two embodiments: (i) Multilayer Narrow band Resonators which together produce the wideband effect; and (ii) One layer pixelized which exhibits a multiresonant (i.e. wideband) effect.

Figure 1:
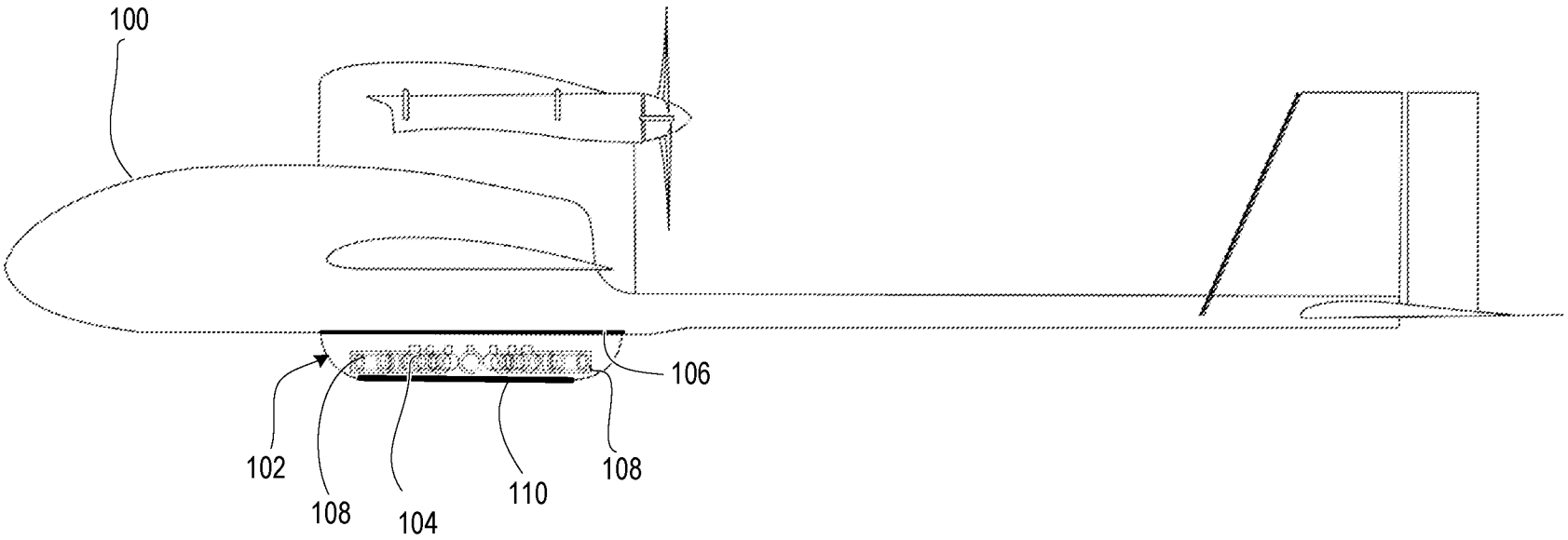
FIG. 1 is a side view of an unmanned aerial vehicle having a wideband diffuser of a circular array of polyrod antennas operating in close proximity of a finite ground covered by multiple layer diffuser (MLD), according to one or more embodiments.

FIG. 1 is a side view of an unmanned aerial vehicle 100 having an antenna assembly 102 that includes an endfire antenna or array 104 that is proximate to a reflecting surface 106 of the unmanned aerial vehicle 100. In one or more embodiments, the endfire antenna or array 104 is a circular array of polyrod antennas 108 operating in close proximity to the reflecting surface, depicted as finite ground 106. Endfire antenna or array 104 is a linear array whose direction of maximum radiation is along the axis of the array. Endfire antenna or array 104 may be either unidirectional or bidirectional, The elements of the endfire antenna or array 104 are parallel, identically spaced, and in the same plane, as in a fishbone antenna. The individual antenna elements of the array carry current of equal amplitude and excited with a progressive phase difference between adjacent antenna elements expressed in wavelengths. A wideband diffuser, specifically a multiple layer diffuser (MLD) 110, reduces the interaction between antennas (104) and a nearby object (106). MLD 110 has a thin textured surface similar to a high-impedance layer that is wrapped around the objects that are in close proximity of the antenna (ground planes, various platforms, etc.). The textured surface acts as a "diffuser" spreading the reflected fields from the close objects and thereby reducing the power otherwise directed in the specular reflections. This method allows reducing the profile of endfire antennas or arrays 104 working in close proximity to various platforms.

The present disclosure extends the concept above for wideband wide angle applications. The method is applicable to any communication systems operating on various platforms, such as base stations, airplanes, unmanned aerial vehicles (UAVs), etc. The requirement for low profile antennas that are conformal to large and finite bodies is not new. Typical examples are antennas mounted on an aircraft pod. The desire is to minimize the profile of these pods, which brings the antennas inside very close to the aircraft body. The aircraft body can be of any size, shape or materials, but when the antenna is brought too close to it, the performance of the antenna will, in most cases, deteriorate. Antennas operating in the close proximity of finite bodies (FB) present significant deficiencies, due to the strong interaction between the two.

Any energy emanating from the antenna undergoes a reflection from the object present in close proximity, resulting in distortion of the radiation pattern. Edge effects from the finite object also contribute to beam distortion. Squint in the main beam, increased cross-polarization, and increased sidelobes are only some of the negative effects of this interaction, which impose constraints on the design of a low profile antenna system that almost blends with the FB.

Topological optimization allows for the design and manufacturing of wide-band wide-angle diffusers. An array of periodic patterns is printed on a thin (in the range of 15 to 20 mils) dielectric substrate. On the other side of the dielectric substrate a full metallization exists. The substrate is applied on the body in the area where the antenna operates.

Figure 2:
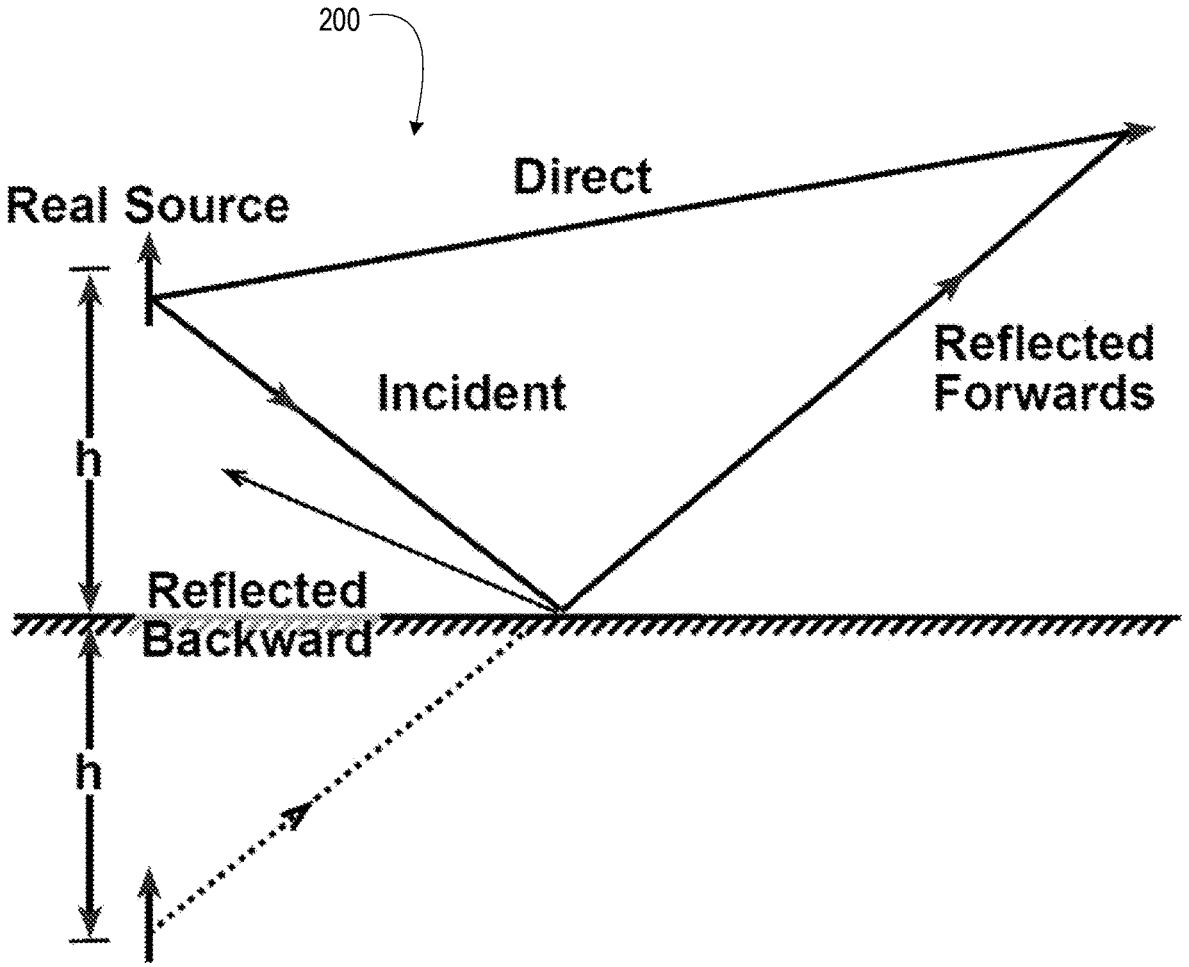
FIG. 2 illustrates a diagram of a theory of operation of planar structures that minimize the reflection from a ground plane over a wide band and over a wide range on incident angles

FIG. 2 illustrates a diagram 200 of a theory of operation of planar structures that minimize the reflection from a ground plane over a wide band and over a wide range on incident angles; Theory of Operation: (i) Balance between Forward Reflected and Incident Wave; and (ii) Balance between the Forward Reflected and Back Reflected. The Reflection Peak from PEC: −20.05 dB; @32 GHz, incident plane @10°-forwards reflection peak: <−24 dB; @32 GHz, incident plane @30°-forwards reflection peak: <−30 dB; @32 GHz, incident plane @10o-backwards reflection peak: <−30 dB; @32 GHz, incident plane @30°-backward$_2$ reflection peak: <−25 dB. Notes: (i) @32 GHz, the PEC Reflected Amplitude is reduced (in the worst case) by a factor of 2.5 in all directions; (ii) The effect is similar across the 31.5 to (about) 36.5 GHz band.

Figure 3:
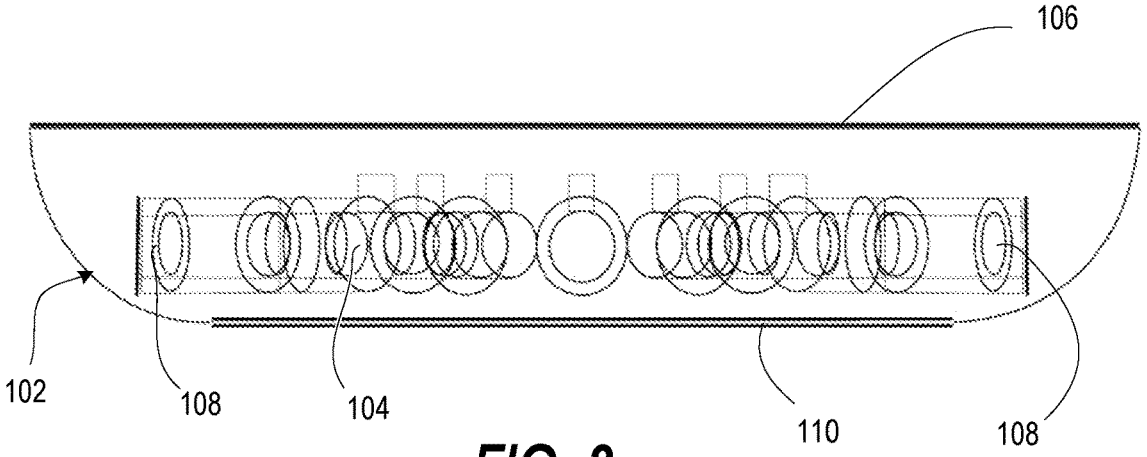
FIG. 3 is a side view of the MLD of FIG. 1, according to one or more embodiments.
Figure 4:
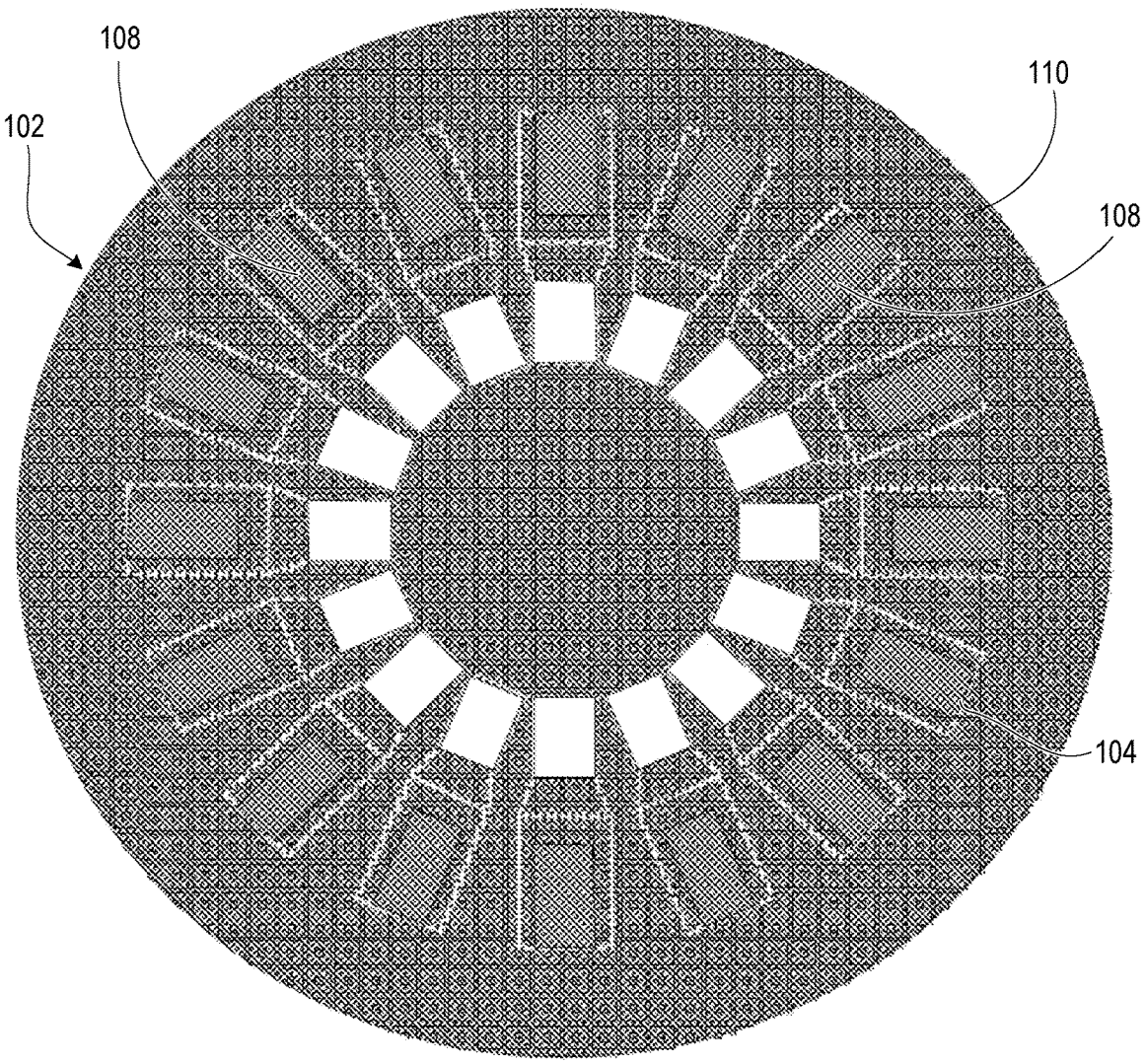
FIG. 4 is a bottom view of the MLD of FIG. 1, according to one or more embodiments.
Figure 5:
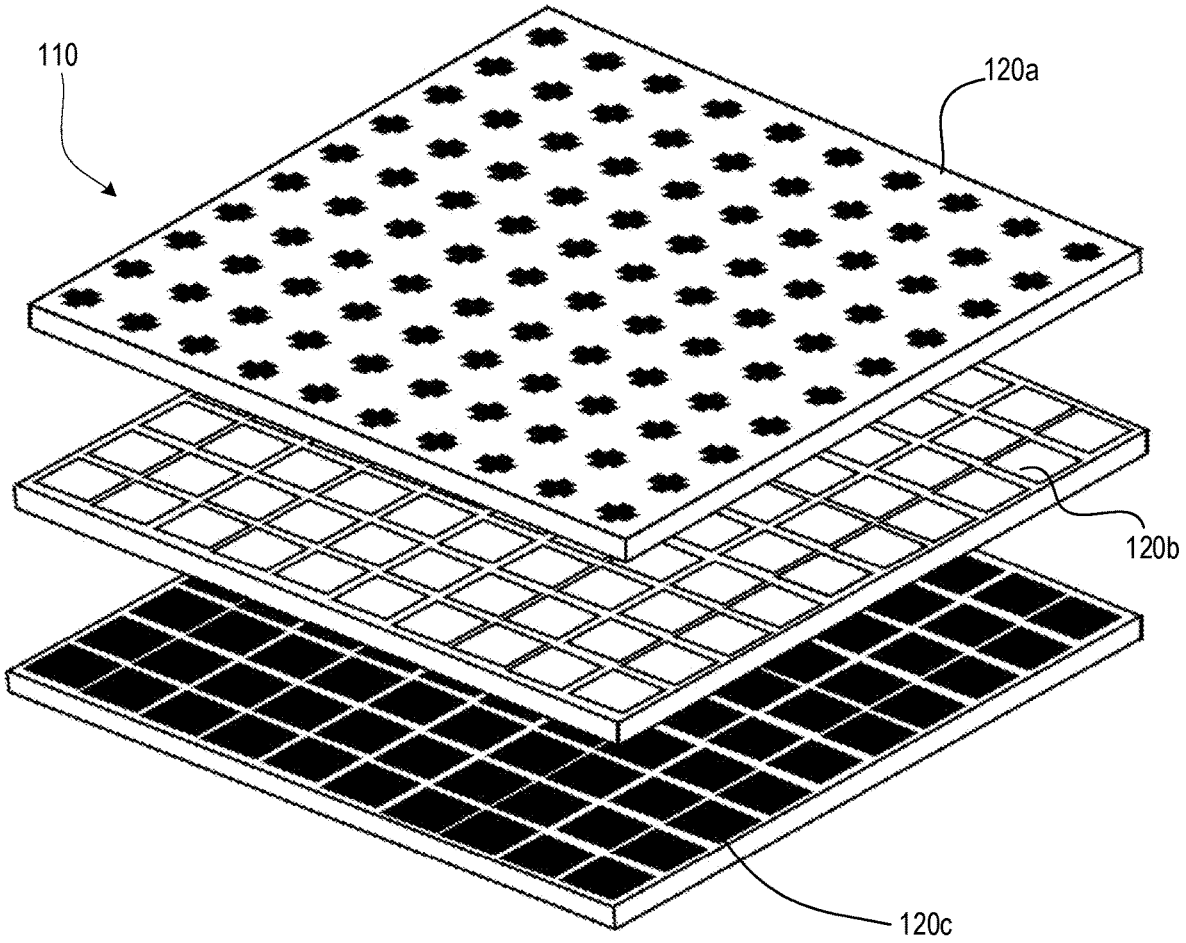
FIG. 5 is an isometric view of a stack of layer diffusers to form a multiple layer diffuser (MLD) with different resonant unit cells meant to achieve bandwidth extension of the diffusing effect, according to one or more embodiments.
Figure 6:
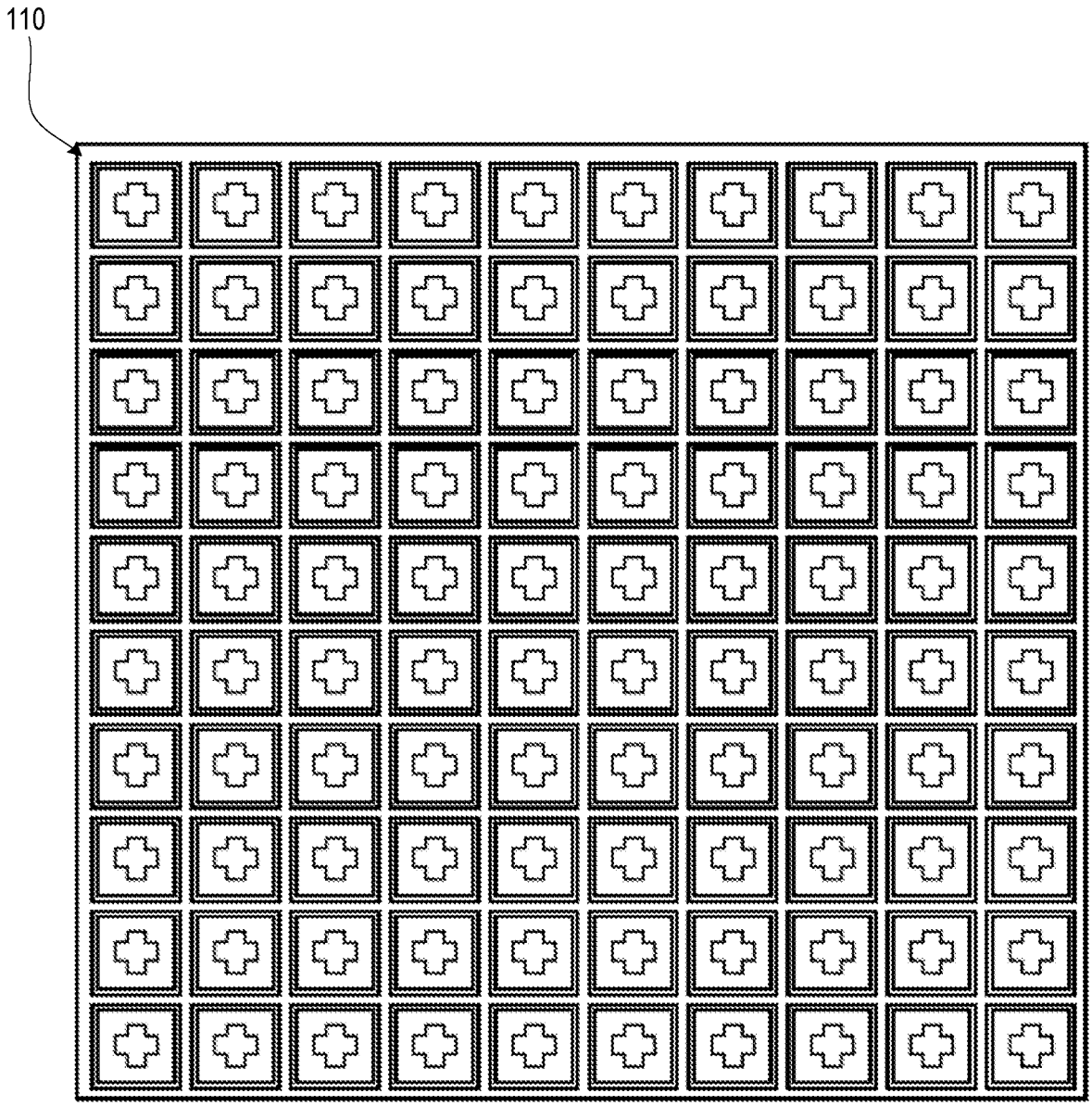
FIG. 6 is a top view of the MLD of FIG. 5, according to one or more embodiments.
Figure 7:
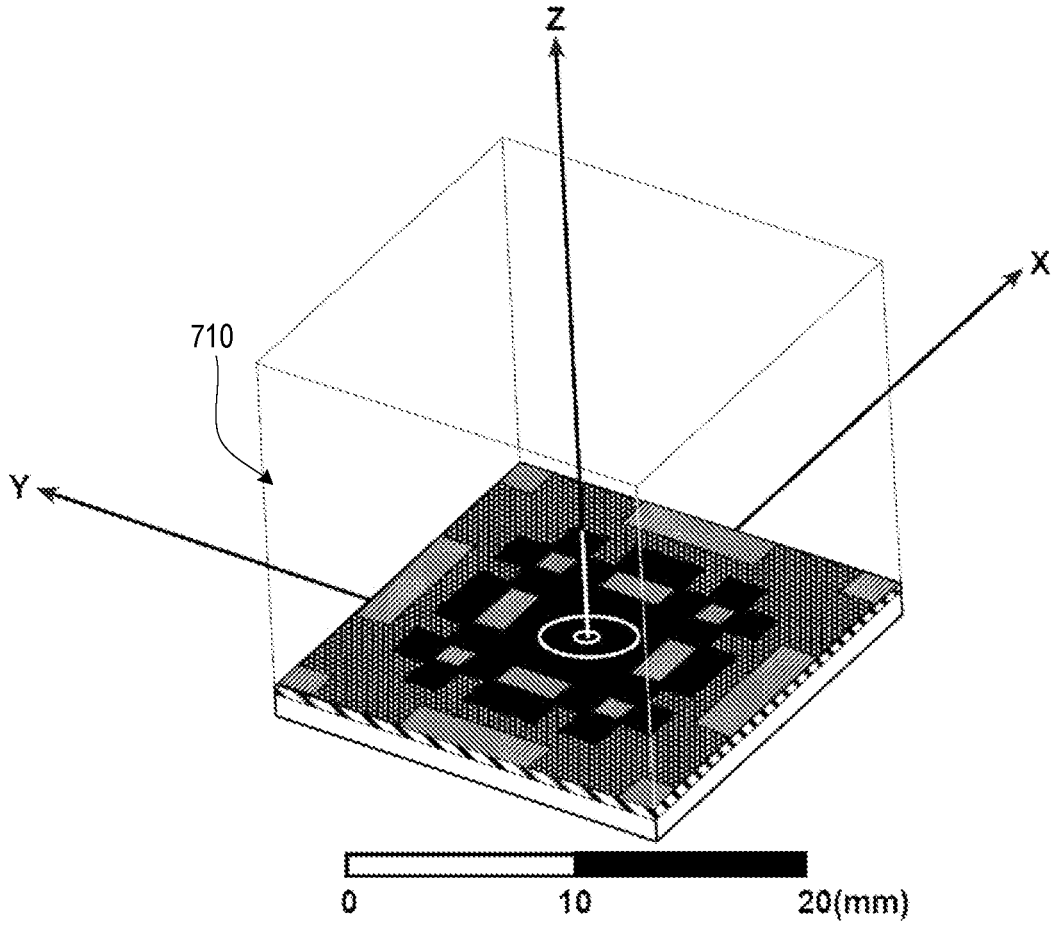
FIG. 7 is an isometric view of a pixelized diffuser (PD) with different resonances embedded into one layer meant to achieve bandwidth extension of the diffusing effect, according to one or more embodiments.
Figure 8:
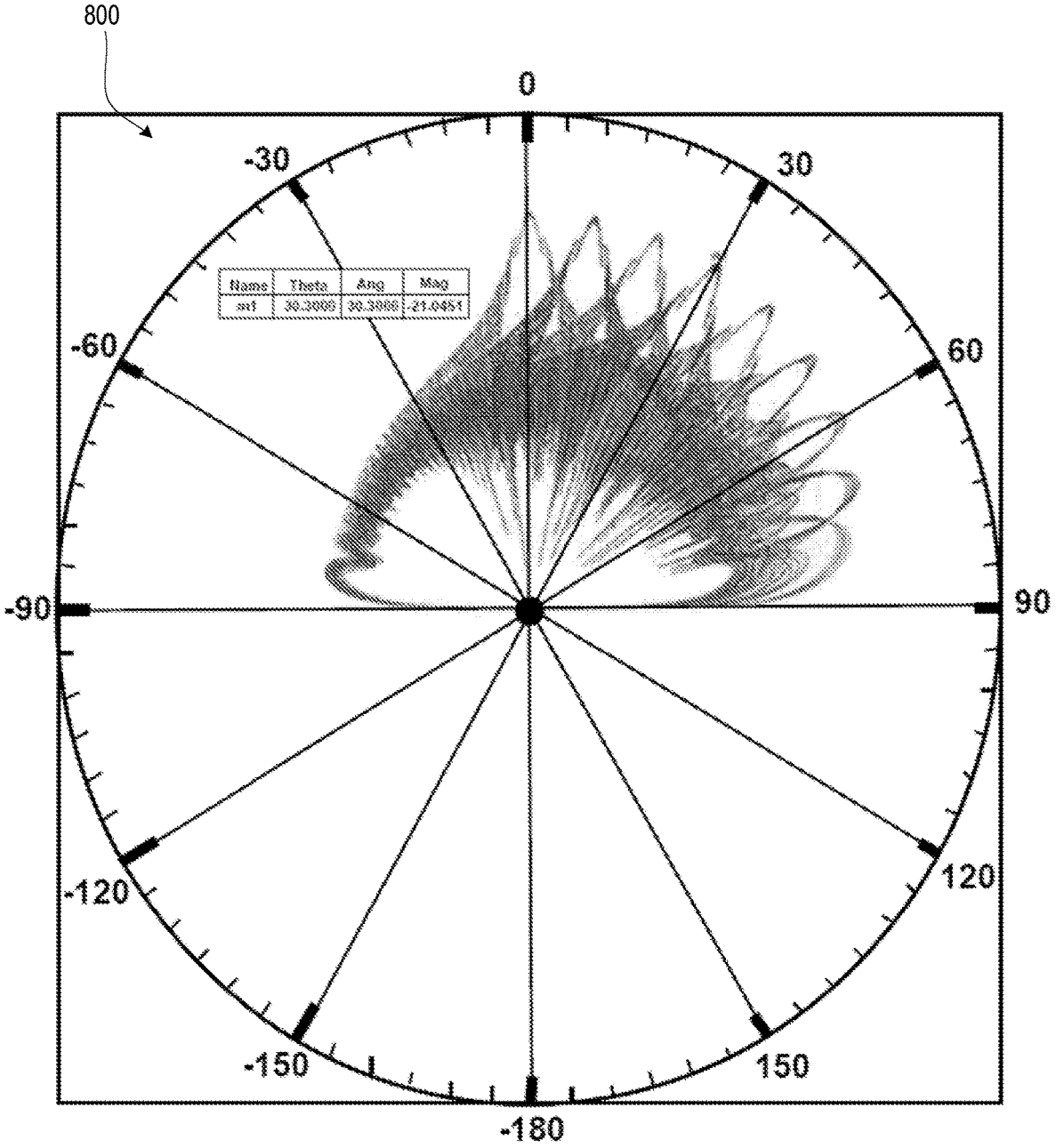
FIG. 8 is a circular plot of performance of a pixelized diffuser reflection coefficient for various incident angles with the backscattering pattern is highly localized and the reflected wave intensity significantly reduced, according to one or more embodiments.
Figure 9:
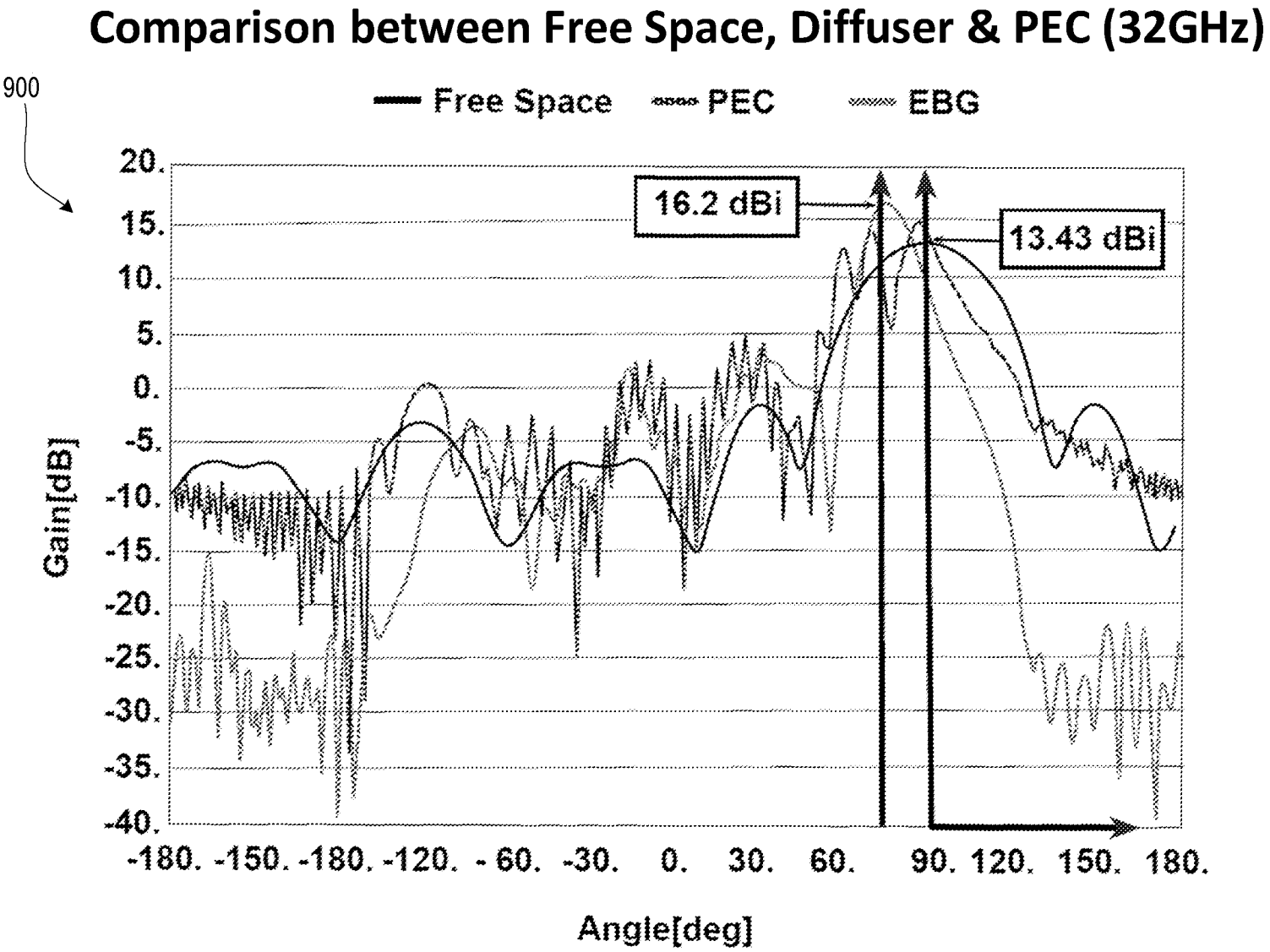
FIG. 9 is an annotated graphical plot of pattern reconstruction using a diffuser, comparing free space, diffuser, and PEC (32 GHz), according to one or more embodiments.

FIG. 3 is a side view of the MLD 110. FIG. 4 is a bottom view of the antenna assembly 102 MLD of FIG. 1. FIG. 5 is an isometric view of the MLD 100 that is a stack of three (3) layer diffusers 120*a*-120*c* with different resonant unit cells meant to achieve bandwidth extension of the diffusing effect. FIG. 6 is a top view of the MLD 110. FIG. 7 is an isometric view of a pixelized diffuser (PD) 710 with different resonances embedded into one layer meant to achieve bandwidth extension of the diffusing effect. FIG. 8 is a circular plot 800 of performance of a pixelized diffuser reflection coefficient for various incident angles with the backscattering pattern is highly localized and the reflected wave intensity significantly reduced. FIG. 9 is an annotated graphical plot 900 of pattern reconstruction using a diffuser, comparing free space, diffuser, and PEC (32 GHz).

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

In the preceding detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. An antenna assembly, comprising:

a planar structure that minimizes the reflection from a proximate reflective surface over a wide band and over a wide range of incident angles, the planar structure comprising:

a first planar layer and a second planar layer, each having a plurality of first areas and a plurality of second areas, the first areas being more conductive than the second areas, wherein each area has a periphery that extends along a grid of first and second sets of parallel lines so that each area comprises one or more contiguous elements defined by the lines, and wherein the first and second areas are configured and arranged so that the planar layer can communicate electromagnetic energy wirelessly in a specific direction to the planar layer when an electrical connection is made to at least one of the first areas, wherein the first planar layer is positioned on top of the second planar layer, the respective second areas of second planar layer aligned with a corresponding second area of the first planar layer; and a finite ground plane that acts as the proximate reflective surface;

an endfire antenna, wherein the planar structure is positioned proximate to the finite ground plane and the endfire antenna.

2. The antenna assembly of claim 1, wherein the first and second sets of parallel lines are orthogonal, the elements are squares, and each the area is a selected one of: (i) square; (ii) rectangle; and (iii) geometric region having orthogonally diverging contiguous segments.

3. The antenna assembly of claim 1, wherein the endfire antenna comprises a unidirectional array of waveguide-fed multimode dielectric polyrod antennas.

4. The antenna assembly of claim 1, wherein the endfire antenna comprises a bidirectional array of waveguide-fed multimode dielectric polyrod antennas.

5. The antenna assembly of claim 1, wherein the first areas comprise a conductive material.

6. The antenna assembly of claim 5, wherein the second areas comprise a dielectric material.

7. The antenna assembly of claim 5, wherein the second areas comprise a semiconductor material.

8. The antenna assembly of claim 1, wherein the first areas comprise a semiconductor material.

9. The antenna assembly of claim 8, wherein the second areas comprise a dielectric material.

10. The antenna assembly of claim 8, wherein the second areas comprise a semiconductor material.

* * * * *